US005475938A

United States Patent [19]

Bergan

[11] Patent Number: 5,475,938

[45] Date of Patent: Dec. 19, 1995

[54] DISPLAY EASEL BACK

[76] Inventor: Norman A. Bergan, 5851 Waggoner, Dallas, Tex. 75230

[21] Appl. No.: 203,949

[22] Filed: Mar. 1, 1994

[51] Int. Cl.[6] ..... A47G 1/06

[52] U.S. Cl. ..... 40/152.1; 248/457

[58] Field of Search ..... 40/152.1, 152, 40/120; 248/457, 465, 472, 558, 688; 240/457

[56] References Cited

U.S. PATENT DOCUMENTS

| | | | |
|---|---|---|---|
| 2,419,823 | 4/1947 | Cross et al. | 40/152.1 |
| 4,622,767 | 11/1986 | Sullivan | 40/152.1 |
| 4,776,552 | 10/1988 | March | 248/455 |
| 4,798,015 | 1/1989 | Ackeret | 40/152.1 |
| 5,068,987 | 12/1991 | Tontarelli | 40/152.1 |
| 5,329,712 | 7/1994 | Keller | 248/558 X |

*Primary Examiner*—Kenneth J. Dorner
*Assistant Examiner*—Cassandra Davis
*Attorney, Agent, or Firm*—Ross, Clapp, Korn & Montgomery

[57] ABSTRACT

A display apparatus having a display body with a square recess in one face thereof cooperating with a square easel foot which may be stored flat therein. The easel foot has a through slot extending from one edge thereof to an end close to the opposite edge. A pair of detent engagement pins are positioned on the sides of the foot on opposite sides of the slot. Storage detent holes in opposed sidewalls of the recess are provided, as well as two pairs of display detent holes on two different opposed walls of the recess.

7 Claims, 2 Drawing Sheets

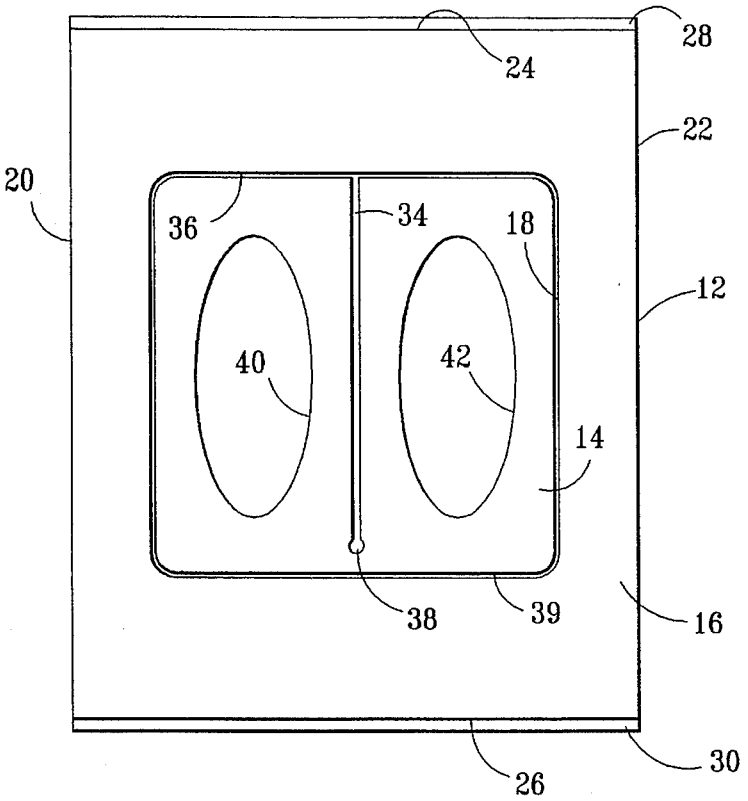
FIG. 2
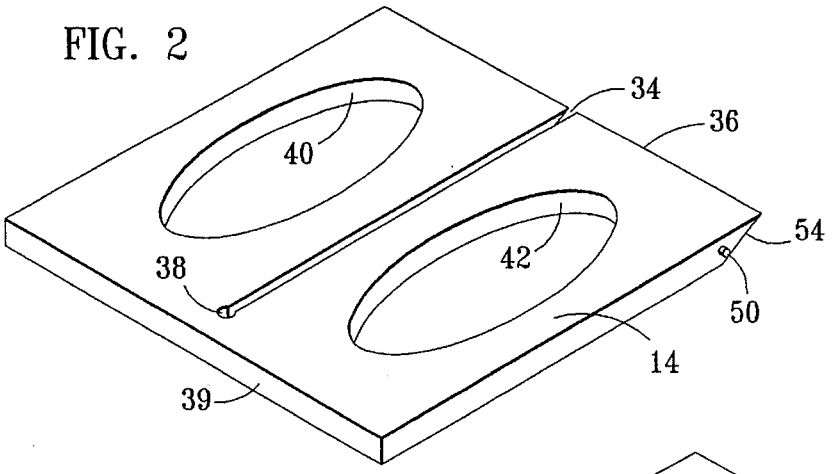
FIG. 3
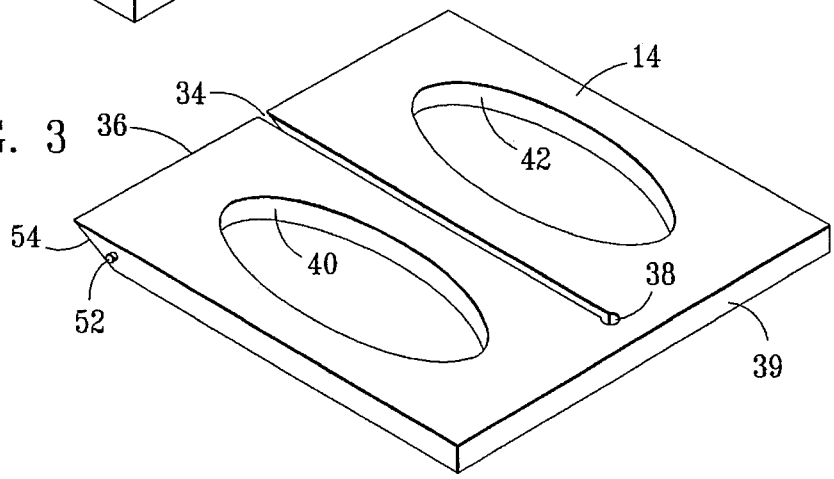

DISPLAY EASEL BACK

TECHNICAL FIELD OF THE INVENTION

This invention relates to display apparatus, and more particularly to a display easel back for supporting a picture frame or similar article at a viewing angle atop a table or other horizontal surface.

BACKGROUND OF THE INVENTION

The conventional picture frame, with the ubiquitous angled cardboard easel foot folding out from the rear panel to support the picture frame on a table or desktop, is well known in the art. This standard in the industry is adequate for supporting a picture frame or other display item at a viewing angle on a horizontal surface, particularly if the back of the display is adjacent a wall or otherwise not prominently in view. Where a viewer may see the back of the article as well as the display face, however, conventional easel foots are not very satisfactory. The objective is to create a display which is pleasing to the eye, while providing solid support for the display. Conventional easel foots do not measure up to the attractiveness and versatility of display apparatus constructed in accordance with the present invention.

SUMMARY OF THE INVENTION

In accordance with the invention, a display apparatus is provided for a picture frame, plaque or similar article. The apparatus comprises a display body having a recess in one face thereof, and an easel foot dimensioned to substantially fill the recess to fit flush within the display body in a storage and transit position. The display foot includes engagement means adapted to permit the easel foot to pivot outwardly from the recess at an acute angle to the display body to support the display body at a viewing angle above a support surface.

In a preferred form of the invention, the display body recess and easel foot have substantial overall dimensional symmetry about a central point, so that the foot may be positioned to support the body in more than one orientation of the body with respect to the support surface. The display body is provided with a pair of storage detent means positioned on opposite sides of its recess, and a pair of display detent means positioned on said opposite sides of the recess. The easel foot has a pair of detent engagement means positioned on opposite sides thereof for engaging, in a first flat position of the easel foot, the storage detent means and, in a second support position of the easel foot, the display detent means.

The easel foot is formed with a through slot from one edge at right angles to a line between the detent engagement means of the foot, so that the foot may be flexed to disengage the engagement means in order to move the engagement means from one pair of display body detent means to another and thus between the storage and display positions. Preferably, finger holes are formed in the foot on opposite sides of the through slot, facilitating flexure of the foot to accomplish release.

In a particular embodiment of the invention, a second pair of display detent means are positioned on opposite sides of the display body recess, oriented so that a line between the detent means of said second pair are non-parallel to a line between the display detent means of said first pair. This enables the user to change the orientation of the display position by using the two different pairs of display detent means. In a specific embodiment, the detent means comprise holes in the side wall of the display body recess, and the detent engagement means of the foot comprise pins protruding outwardly therefrom.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which:

FIG. 1 is a rear view of a display back constructed in accordance with the present invention, shown with the easel foot in the flat or storage position;

FIG. 2 is a perspective view of the easel foot of FIG. 1;

FIG. 3 is a view similar to FIG. 2, taken from the opposite side of the foot;

DESCRIPTION OF THE PREFERRED EMBODIMENT

Figure 4:
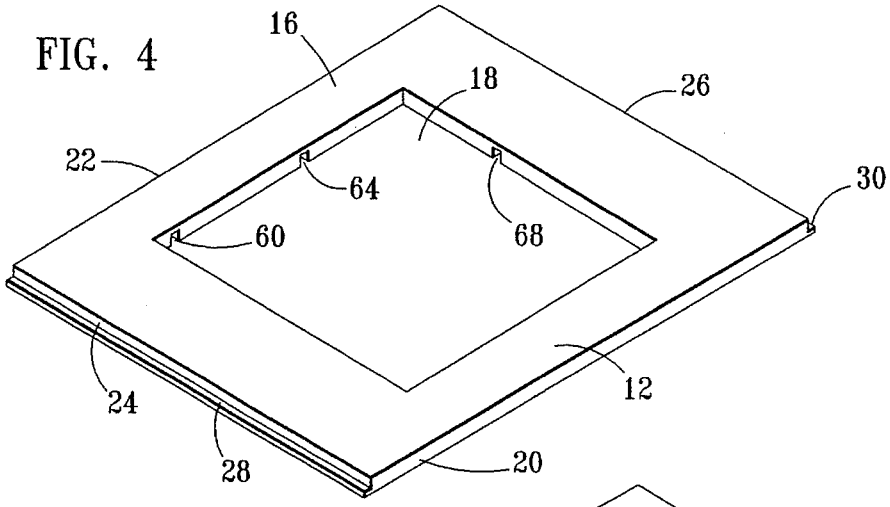
FIG. 4 is a perspective view of the display body back of FIG. 1.
Figure 5:
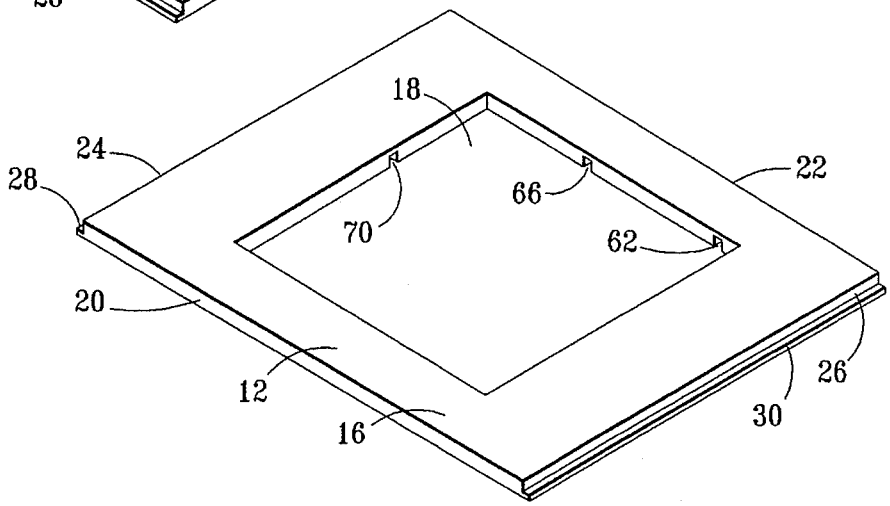
FIG. 5 is a view similar to FIG. 4 taken from the opposite side of the display body back.

Display apparatus for use with a picture frame is shown assembled in the storage or transit position in FIG. 1. The apparatus consists of display body 12 and a separate easel foot 14. The rear face 16 of display body 12 is provided with a central recess 18 which is substantially square. Rear surface 16 is bounded by opposed long edges 20 and 22 and opposed short edges 24 and 26 to define a rectangular shape generally corresponding to the dimensions of the picture frame in which display body 12 is to be installed. Mounting tongues 28 and 30 extend outwardly from the footprint of surface 16 at the short edges 24 and 26 in order to provide a simple mechanism for securing display body 12 in the picture frame.

Easel foot 14 is formed in a substantially square configuration so that it fits inside of recess 18 in display body 16. The thickness of easel foot 14 is substantially the same as the depth of recess 18, so that in the storage position depicted in FIG. 1, easel foot 14 is substantially flush with the back surface 16 of display body 12. Through slot 34 is formed entirely through the thickness of easel foot 14 from edge 36 of the foot. Slot 34 terminates at an end 38 near the opposite edge 39 of foot 14 so that it traverses the major portion of foot 14. Slot 34 should extend sufficiently to permit flexing of the foot to reduce the width of slot 34, although the foot must have memory to return to its state shown in FIGS. 1–3. Finger hold apertures 40 and 42 are formed in foot 14 on opposite sides of slot 38. Specific details of the construction of display body 12 and easel foot 14 for interconnecting the two pieces in at least two display positions as well as the flat storage position can be seen in FIGS. 2 through 5. Pins 50 and 52 are located on opposite sides of slot 34 in foot 14, near the edge 36 of the foot. Beveled surface 54 is undercut from edge 36, to enable pivoting of the foot 14 with respect to display body 12, and to provide a stop for engaging the bottom of recess 16.

Pins 50 and 52 serve as detent engagement means for mounting foot 14 in selected positions in display body 12.

Storage detent means are provided in display body 12 for receiving pins 50 and 52 in the position illustrated in FIG. 1, and take the form of holes 60 and 62 located in the opposed sidewalls of recess 18 near the edge 24 of display body 12. Holes 60 and 62 are oriented so that, when pins 50 and 52 are engaged therein, the easel foot 14 lie flat in recess 18 as shown in FIG. 1.

Figure 6:
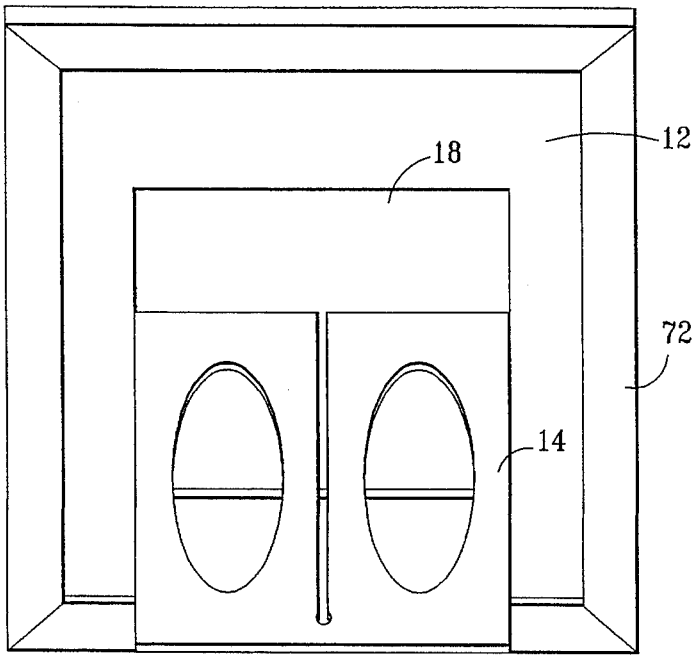
FIG. 6 is a rear view of the foot of FIGS. 2 and 3 in a display position with respect to the display back of FIGS. 4 and 5, installed on a picture frame.
Figure 7:
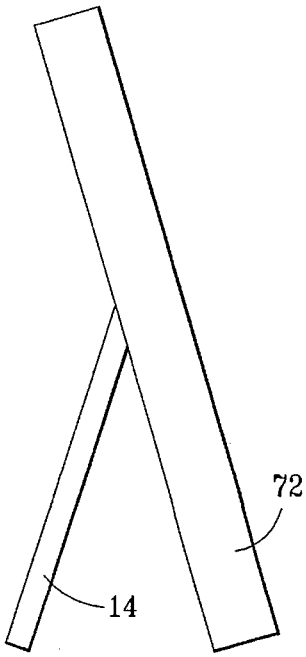
FIG. 7 is a side view corresponding to FIG. 6.

Display body 12 is provided with display support holes 64 and 66 in the same sidewalls as holes 60 and 62, which serve the purpose of receiving pins 50 and 52 for supporting the display with 24 at the top of the display, as shown in FIGS. 6 and 7.

In addition, a second pair of display detent holes 68 and 70 may be positioned in the other two walls of recess 18 in order to turn the display so that edge 22 is positioned at the top.

As shown in FIGS. 6 and 7, display body 12 may be inserted in the rear of a picture frame 72, mounted by means of tongues 28 and 30 in complementary slots in the frame. The frame may be provided with spring means on one of its slots to hold the display body 12 firmly in position.

Desirably, display body 12 and easel foot 14 are formed from wood complementing the material of frame 70, although other materials may be selected. If wood is used, the grain of easel foot 14 should be oriented so that it is at right angles to slot 34. The material of foot 14 should, in all events, flex to reduce the slot to disengage pins 50 and 52, and exhibit memory so that it returns to the position shown in FIG. 1. It will also be appreciated that display body 12 may be fabricated integrally with the entire display article. This may occur, for example, when the display article is a presentation plaque rather than a frame with removable picture.

In use, the easel foot 14 may be easily positioned into either of the display detent pairs 64 and 66, or 68 and 70, simply by gripping finger hold apertures 40 and 42 and squeezing them toward one another to reduce the width of slot 34 and free pins 50 and 52 from the engaged detents. The foot 14 may then be moved to the desired position. It will also be appreciated that the unit may be hung on the wall if that is desired with the foot 14 in the storage position, since slot 34 gives ready means for suspending display body 12 from a nail or other hanger.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. Display apparatus comprising:

(a) A display body having a recess in one face thereof having a plurality of sides a pair of storage detent means positioned on opposite sides of the recess, a first pair of display detent means positioned on said opposite sides of the recess and a second pair of display detent means positioned second on opposite sides of the display body recess such that a line between the detent means of said second pair is non-parallel to a line between the display detent means of said first pair; and (b) an easel foot dimensioned to substantially fill the recess to fit flush within the display body, and having a pair of detent engagement means positioned on opposite sides thereof for engaging: in a first position of the easel foot, the storage detent means; in a second position of the easel foot, the first pair of display detent means, whereby the foot in the second position is adapter to support the display body upon a horizontal surface support surface; and in a third position of the easel foot, the second pair of display detent means, whereby the foot is adapter to support the display body at a different orientation upon the support surface.

2. The apparatus of claim 1, further comprising a through slot formed from one edge of said easel foot at right angles to a line between said detent engagement means, whereby the foot may be flexed to disengage the engagement means such that the detent engagement means may be removably engaged with one of the storage, first air and second pair of detent means.

3. The apparatus of claim 2, further comprising finger holds formed in the foot on opposite sides of said through slot for facilitating flexure of the foot.

4. The apparatus of claim 1 wherein each detent means comprises a hole in the display body, and the detent engagement means comprises pins on the easel foot.

5. Display apparatus comprising:

(a) a display body having a recess in one face thereof; and (b) an easel foot dimensioned to fit in the recess in the display body, said easel foot having a length and having a central through slot having a length less than the length of the easel foot extending from an edge of the foot through a substantial portion all of the easel foot and having display body engagement means for cooperation with the display body, adapted in a first flat position of the easel foot to engage the display body to hold the easel foot in a storage position in the recess, and in a second position of the easel foot to engage the display body to hold the easel foot so that it is permitted to extend outwardly from the recess at an acute angle to support the display body in a front display position, and in a third position of the easel foot to engage the display body to hold the easel foot so that it is permitted to extend outwardly from the recess at an acute angle to support the display body in a second display position substantially perpendicular to the first display position; whereby the easel foot may be flexed to reduce the width of the slot to disengage the display body engagement means from the display body such that the detent engagement means may be selectedly moved to one of the storage, first and second position.

6. Display apparatus comprising:

(a) A display body having a recess in one face thereof;

(b) an easel foot dimensioned to fit in the recess in the display body, and having display body engagement means for cooperation with the display body, adapted in a first flat position of the easel foot to engage the display body to hold the easel foot in a storage position in the recess, and in a second position of the easel foot to engage the display body to hold the easel foot so that it is permitted to extend outwardly from the recess at an acute angle to support the display body; and (c) release means associated with the easel foot for disengaging the engagement means to permit movement of the easel foot between said storage and display positions, said release means comprising a through slot formed in the easel foot extending from one edge of the easel foot a substantial distance across the easel foot, whereby the easel foot may be flexed to reduce the width of the slot and effect such disengagement.

7. Display apparatus comprising:

(a) a display body having a recess in one face thereof and at least first and second opposed detent pair means on opposite sides of the recess;

(b) an easel foot dimensioned to substantially fill the recess in the display body, and having a central through slot extending from one edge thereof through a substantial portion, but not all, of the easel foot;

(c) detent engagement means associated with the easel foot for cooperation with the first and second pairs of detent means of the display body, adapted in a first position of the easel foot to engage the first pair of display body detent means to permit the easel foot to lie flat in the recess, and in a second position of the easel foot to engage the second pair of display body detent means to hold the easel foot so that it is permitted to extend outwardly from the recess at an acute angle to support the display body; and (d) finger holds on either side of the slot for exerting pressure to reduce the width of the slot to disengage the detent engagement means of the easel foot from the display body so that the easel foot may be moved between the first and second positions.

* * * * *

UNITED STATES PATENT AND TRADEMARK OFFICE

CERTIFICATE OF CORRECTION

PATENT NO. : 5,475,938

DATED : December 19, 1995

INVENTOR(S) : Norman A. Bergan

It is certified that error appears in the above-identified patent and that said Letters Patent is hereby corrected as shown below:

Column 3, line 55, following "thereof" insert -- , --;

Column 4, line 4, delete "adapter" and substitute -- adapted --;

line 7, delete "adapter" and substitute -- adapted --;
line 14, delete "air" and substitute -- pair --;
line 28, delete "all".

Signed and Sealed this

Twenty-fourth Day of September, 1996

*Attest:*

Bruce Lehman

BRUCE LEHMAN

*Attesting Officer*

*Commissioner of Patents and Trademarks*